US006752871B2

(12) United States Patent
Bitterich et al.

(10) Patent No.: US 6,752,871 B2
(45) Date of Patent: Jun. 22, 2004

(54) COATING SYSTEM FOR COATING PRINT CARRIERS AND COATING MACHINE HAVING THE SYSTEM

(75) Inventors: Wolfgang Bitterich, Gemmingen (DE); Bernd Heller, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/356,108

(22) Filed: Jan. 31, 2003

(65) Prior Publication Data

US 2003/0140803 A1 Jul. 31, 2003

(30) Foreign Application Priority Data

Jan. 31, 2002 (DE) ..... 102 03 693

(51) Int. Cl.[7] ..... B05C 11/02

(52) U.S. Cl. ..... 118/110; 118/118; 118/123; 118/261; 118/262; 118/413; 118/414; 118/117

(58) Field of Search ..... 118/46, 683, 684, 118/110, 117, 118, 123, 211–213, 261, 262, 413, 414; 427/356, 359; 101/148, 423, 424.2

(56) References Cited

U.S. PATENT DOCUMENTS 5,109,770 A * 5/1992 Uribe et al. ..... 101/425
5,277,111 A * 1/1994 Uribe et al. ..... 101/425
5,558,020 A 9/1996 Marozzi et al.
6,419,750 B1 * 7/2002 Tabak et al. ..... 118/684
6,546,861 B2 * 4/2003 Manser ..... 101/169

FOREIGN PATENT DOCUMENTS

| | | |
|---|---|---|
| DE | 42 15 726 C2 | 9/1993 |
| DE | 296 16 868 U1 | 1/1997 |
| DE | 297 22 601 U1 | 3/1998 |
| DE | 197 57 094 A1 | 6/1999 |
| DE | 299 13 778 U1 | 11/1999 |
| DE | 199 02 567 A1 | 8/2000 |

* cited by examiner

*Primary Examiner*—Laura Edwards
(74) *Attorney, Agent, or Firm*—Laurence A. Greenberg; Werner H. Stemer; Ralph E. Locher

(57) ABSTRACT

A coating system for coating print carriers includes at least one pump, at least one selection valve, a first metering device and a second metering device. The first metering device and the second metering device are constructed differently from one another with respect to metering principles thereof. The pump and the selection valve are assembled into a modular supply unit constructed so as to be compatible both with the first and with the second metering device. A coating machine, such as a printing or varnishing machine which includes the coating system, is also provided.

13 Claims, 3 Drawing Sheets

COATING SYSTEM FOR COATING PRINT CARRIERS AND COATING MACHINE HAVING THE SYSTEM

BACKGROUND OF THE INVENTION

Field of the Invention

The invention relates to a coating system for coating print carriers, the coating system having at least one pump, at least one selection valve, a first metering device and a second metering device. The invention also relates to a coating machine having the coating system.

Such coating systems serve, for example, for coating print carriers with zinc white primers, metallic printing inks or clear varnish coats.

German Utility Model DE 296 16 686 U1 illustrates a coating system (note FIG. 4 therein) corresponding to the general type mentioned in the introduction hereto wherein, according to the description that is given, depending upon the printing order, one of the metering devices can be exchanged. The aforementioned utility model illustrates a further coating system (note FIG. 1 therein) which includes only a single metering device and therefore does not actually correspond to the general type of coating systems mentioned in the introduction hereto. This metering device may be constructed in accordance with the anilox metering principle, the scoop-roller metering principle or the nip-roller metering principle.

The specialized journal "Deutscher Drucker" [German Printer], number 34 of Sep. 13, 2001, page 26, describes a new product line of the company Harris and Bruno Europe GmbH for fully automatic in-line cleaning, wherein, according to the description given, it is not necessary to change hose systems or pumps, and a chambered doctor blade can remain in position.

Furthermore, the German Utility Model DE 299 13 778 U1 describes a coating system which includes a metering device and a circulation line system. The metering device includes a screen or engraved roller and is therefore constructed in accordance with the anilox metering principle. The circulation line system is made up of a supply line, a return line and pumps. The supply line and the return line are couplable with the metering device. In this last-mentioned utility model, it is noted as advantageous that the circulation line system manages without switching valves and would consequently be uncomplicated.

SUMMARY OF THE INVENTION

It is accordingly an object of the invention to provide a coating system for coating print carriers and a coating machine having the system, which overcome the hereinafore-mentioned disadvantages of the heretofore-known devices of this general type.

With the foregoing and other objects in view, there is provided, in accordance with the invention, a coating system for coating print carriers. The system comprises at least one pump, at least one selection valve, a first metering device and a second metering device. The first metering device and the second metering device are constructed differently from one another with respect to metering principles thereof. The at least one pump and the at least one selection valve are assembled or combined into a modular supply unit constructed so as to be compatible both with the first and with the second metering device.

In accordance with another feature of the invention, the first metering device includes, in accordance with the pan-roller metering principle, a storage trough and a dip or pan roller.

In accordance with a further feature of the invention, the second metering device includes, in accordance with the anilox metering principle, a doctor blade and a screen roller.

In accordance with an added feature of the invention, the coating system further includes connecting lines for connecting the supply unit to the first metering device.

In accordance with an additional feature of the invention, the first metering device and the second metering device have respective connections. One of the connecting lines is connected to the connection of the first metering device and is constructed for fitting together with the connection of the second metering device and is thereby connectable to the connection of the second metering device.

In accordance with yet another feature of the invention, the connecting lines are coupled via couplings with further connecting lines which are connected to the supply unit.

In accordance with yet a further feature of the invention, the coating system further includes a coating machine provided with the first metering device. The coating machine has a machine frame or stand, and the couplings are disposed locally fixed on the machine stand.

In accordance with yet an added feature of the invention, the supply unit has a frame or stand whereto the pump and a selection valve are fastened.

In accordance with yet an additional feature of the invention, the frame or stand is a closed housing within which the pump and the selection valve are disposed.

In accordance with still another feature of the invention, the coating system further includes a coating-liquid reservoir assigned to the supply unit. The reservoir is disposed outside the housing.

With the objects of the invention in view, there is also provided a coating machine, comprising a coating system for coating print carriers. The system includes at least one pump, at least one selection valve, a first metering device and a second metering device. The first metering device and the second metering device are constructed differently from one another with respect to metering principles thereof. The at least one pump and the at least one selection valve are assembled into a modular supply unit constructed so as to be compatible both with the first and with the second metering device.

In accordance with a further feature of the invention, the coating machine is a printing machine.

In accordance with a concomitant feature of the invention, the coating machine is a varnishing machine.

Thus, the coating system according to the invention has a first metering device and a second metering device which are constructed differently from one another in terms of metering principles thereof. The pump and the selection valve are assembled or combined for forming a modular supply unit or assembly. The supply unit is constructed so as to be compatible both with the first and with the second metering device.

One advantage resulting from the difference between the metering devices is that different coating liquids can be printed by the coating system. For example, a high-viscosity coating liquid can be metered and printed with the aid of the first metering device, and a low-viscosity coating liquid can be metered and printed with the aid of the second metering device.

Advantages resulting from the pump being assembled or combined with the selection valve into a structural unit in the form of the supply unit or assembly are the compact form of construction and therefore the low space requirement of this supply unit. The supply unit may be integrated, for example, into a cabinet or shelf next to a printing or varnishing machine including the metering devices.

An advantage which is to be particularly emphasized is that the supply unit is constructed so as to be selectively couplable with the first and with the second metering device. To execute a printing order, the supply unit, in the state wherein it is coupled to the first metering device, can be operated together with the latter, while the second metering device is not required for executing the printing order and is uncoupled or decoupled from the supply unit. To execute another printing order for which the second metering device is required, but not the first metering device, the second metering device can be coupled, instead of the first metering device, to the supply unit, so that the supply unit and the second metering device can be operated jointly.

The coating system according to the invention may be associated with only a single coating machine, for example a printing machine. For example, the metering devices may be constructed as interchangeable devices which can be inserted selectively, in exchange for one another, into a varnishing unit of the printing machine. In this case, the metering device inserted, respectively, into the varnishing unit is connected to the supply unit which is assigned to the varnishing unit. During the operation of the metering device inserted into the varnishing unit, together with the supply unit, the other metering device may be intermediately stored, maintained or operated within another varnishing unit of the printing machine, the other varnishing unit likewise having a supply unit assigned thereto.

The coating system according to the invention may, however, also be associated jointly with a plurality of coating machines, for example a first printing machine and a second printing machine. For example, the first metering device may be an integral part of a varnishing unit of the first printing machine, and the second metering device an integral part of a varnishing unit of the second printing machine. In this case, the advantages of the coating system according to the invention are brought to bear in a particular way when the supply unit is assigned to the varnishing unit of the first printing machine, such a supply unit is assigned to the varnishing unit of the second printing machine, and the metering devices are constructed as interchangeable devices exchangeable in relation to one another, i.e., the first metering device may also be inserted into the second printing machine, and the second metering device also into the first printing machine.

Further features of the coating system according to the invention and the advantages thereof are described hereinbelow.

In a development or feature which is advantageous in terms of printing of a comparatively high-viscosity coating liquid, the first metering device is constructed in accordance with the scoop-roller metering principle. Consequently, the first metering device includes a storage trough, wherein the coating liquid is intermediately stored, and a dip roller which is disposed in the storage trough and which scoops the coating liquid out of the storage trough.

In a development which is advantageous in terms of printing of a comparatively low-viscosity coating liquid, the second metering device is constructed in accordance with the anilox metering principle. Consequently, the second metering device includes a screen or engraved roller and a doctor blade which bears against the screen or engraved roller. The term "anilox roller", according to which the metering principle of the second metering device is named, is also often used for the terms screen or engraved roller. The screen or engraved roller may have a well or cell screen or be a hatched roller provided with a line screen. The doctor blade may be a two-blade (working blade, closing blade) chambered doctor blade. Depending upon the construction of the chambered doctor blade, the coating liquid can be maintained, within a chamber of the chambered doctor blade, either only under a static pressure (passive pressure) or both under static pressure and under a dynamic pressure (active pressure).

There may, of course, also be provision for constructing either the first metering device or the second metering device in accordance with the nip-roller metering principle. It is likewise possible, in addition to the first metering device constructed in accordance with the scoop-roller metering principle, and to the second metering device constructed in accordance with the anilox metering principle, also to provide a third metering device which is associated with the coating system and which is constructed in accordance with the nip-roller metering principle and likewise so as to be compatible with the supply unit or assembly. It is specific to the nip-roller metering principle that the correspondingly constructed metering device includes two rollers together forming a roller nip, and the roller nip has an upwardly open wedge, into which the coating liquid is fed by a supply line, and wherein a small supply of coating liquid is intermediately stored.

In a development which is advantageous in terms of the formation of a liquid circuit, the supply unit is connected to the first metering device via a plurality of connecting lines, i.e., hollow liquid lines (tubes or hoses).

In a development which is advantageous in terms of decoupling the supply unit from the first metering device and coupling the supply unit to the second metering device, at least one of the connecting lines is connected to a connection of the first metering device and is constructed so as to be connectable to a connection of the second metering device. The connecting line is thus constructed so as to be compatible both with the connection of the first metering device and with the connection of the second metering device and, after being released from the connection of the first metering device, can be connected to the connection of the second metering device. The connecting line compatible with the connections of the metering devices can be attached with the end thereof opposite the connections to the supply unit. According to the development described here, the attachment of the connection line to the supply unit may be of a permanent nature, and it is not necessary to release the connecting line from the supply unit in order to decouple the supply unit from the first metering device and couple it to the second metering device. In terms of the maintenance of the coating system, however, it is advantageous if the connecting line is not attached permanently to the supply unit, but rather releasably. A connection, disposed on the supply unit, for the connecting line may serve for the releasable attachment of the connecting line to the supply unit. The connecting line compatible with the connections of the metering devices may be attached with the end thereof opposite the connections not to the supply unit, but, instead, to a coupling which couples the connecting line to a further connecting line, of which the end opposite the coupling is attached to the supply unit. The coupling may be disposed locally fixed on a machine stand of a coating machine containing the first metering device.

In a development which is likewise advantageous in terms of decoupling or uncoupling the supply unit from the first metering device and coupling the supply unit to the second metering device, the at least two or more connecting lines are attached to the first metering device and are coupled via a corresponding number of couplings to a corresponding number of further connecting lines which are connected to the supply unit. Thus, according to the development described here, there are connecting lines, each of which is attached with one end to the supply unit and with the other end thereof to one of the couplings, respectively. Moreover, according to the development described here, there are connecting lines, each of which is attached with one end to the first metering device and with the other end thereof to one of the couplings, respectively. The couplings may be readily releasable quick-action couplings and may be disposed on a machine stand, preferably a machine side wall, of a coating machine containing the first metering device, locally fixed and close to one another, i.e., in the manner of a multiple plug socket installed on a wall.

In another development which is advantageous in terms of decoupling or uncoupling the supply unit from the first metering device and coupling the supply unit to the second metering device, a first connecting line, via which the supply unit is connected to the first metering device, is connected to a connection of the supply unit, and a second connecting line attached to the second metering device is constructed to fit together with the connection of the supply unit and thus be connectable to the connection. The connection of the supply unit is thus constructed so as to be compatible both with the first connecting line used for the first metering device and with the second connecting line used for the second metering device. In order to uncouple the supply unit from the first metering device and couple it to the second metering device, the second connecting line is connected, instead of the first connecting line, to the connection disposed on the supply unit. Those ends of the connecting lines which are opposite the connection of the supply unit may be attached to the metering devices permanently or in a readily releasable manner. In terms of the maintenance of the coating system, it is advantageous if the first connecting line is attached to the first metering device in a readily releasable manner via a connection disposed on the first metering device, and the second connecting line is attached to the second metering device in a readily releasable manner via a connection disposed on the second metering device.

In the case of a hoselike construction of the connecting line connectable to the respective connection, each of the abovementioned connections of the metering devices and of the supply unit may be in the form of a tubular nipple, onto which the connecting line is slipped and secured by a hose clip. Instead of the hose-coupling type formed of the tubular nipple and hose clip, other types of hose couplings are also suitable for forming each of the connections mentioned. For example, the connecting lines may be connected to the metering devices and to the supply unit via adapters.

In a development which is advantageous in terms of the stability of the supply unit, the latter includes a stand which carries the pump and the selection valve. In addition to the pump already mentioned and to the selection valve already mentioned, a further pump and/or at least one further selection valve (preferably a plurality of further selection valves) and/or an electrical control device may be fastened to the stand. The stand may be in the form of a shelf unit composed of plates or be in the form of a frame composed of battens or tubes.

In a development which is advantageous in terms of the protection of the pump (or pumps), of the selection valve (or selection valves) and, if appropriate, of the electrical control device against dirt, the stand is in the form of a closed housing, within which are disposed the pump (or pumps), the selection valve (or selection valves) and, if present, the control device. The at least approximately box-shaped housing is preferably closed on all sides. In specific instances, instead of the housing being closed all-around, a housing open to one side is also acceptable, for example when the open side of the housing is covered by an adjacent wall, for example a machine side wall or a building wall. Preferably, the housing is in the form of a cabinet provided with at least one door. The dirt against which the parts of the supply unit are to be protected by being disposed within the housing is primarily fluff originating from the print carriers and, where appropriate, powder with which the print carriers, if these are print carrier sheets, are dusted in the sheet delivery of the coating machine. By having the sensitive parts of the supply unit be encased by the housing, it is possible, without regard to the dirt source, namely the coating machine, to place the supply unit as near to the latter as is desired. It is consequently possible to keep the length of the connecting lines very short, thus resulting, in turn, in advantages (reduced consumption of cleaning agents) in the case of an automated self-cleaning of the coating system.

In a development which is advantageous in terms of changing the coating liquid printed by the coating system, a coating-liquid reservoir containing the coating liquid is disposed outside the housing of the supply unit. Thus, instead of the coating-liquid reservoir, another coating-liquid reservoir filled with another coating liquid can be coupled with the supply unit without major outlay, if it is necessary to change the coating liquid from one printing order to another.

The advantages of the coating system according to the invention become clear not only to the user thereof, but also to the manufacturer of the coating system. The latter no longer needs to manufacture another special supply device for each of the metering devices and, instead, can deliver one and the same modular supply unit together with each of the various metering devices.

Other features which are considered as characteristic for the invention are set forth in the appended claims.

Although the invention is illustrated and described herein as embodied in a coating system for coating print carriers and a coating machine having the system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
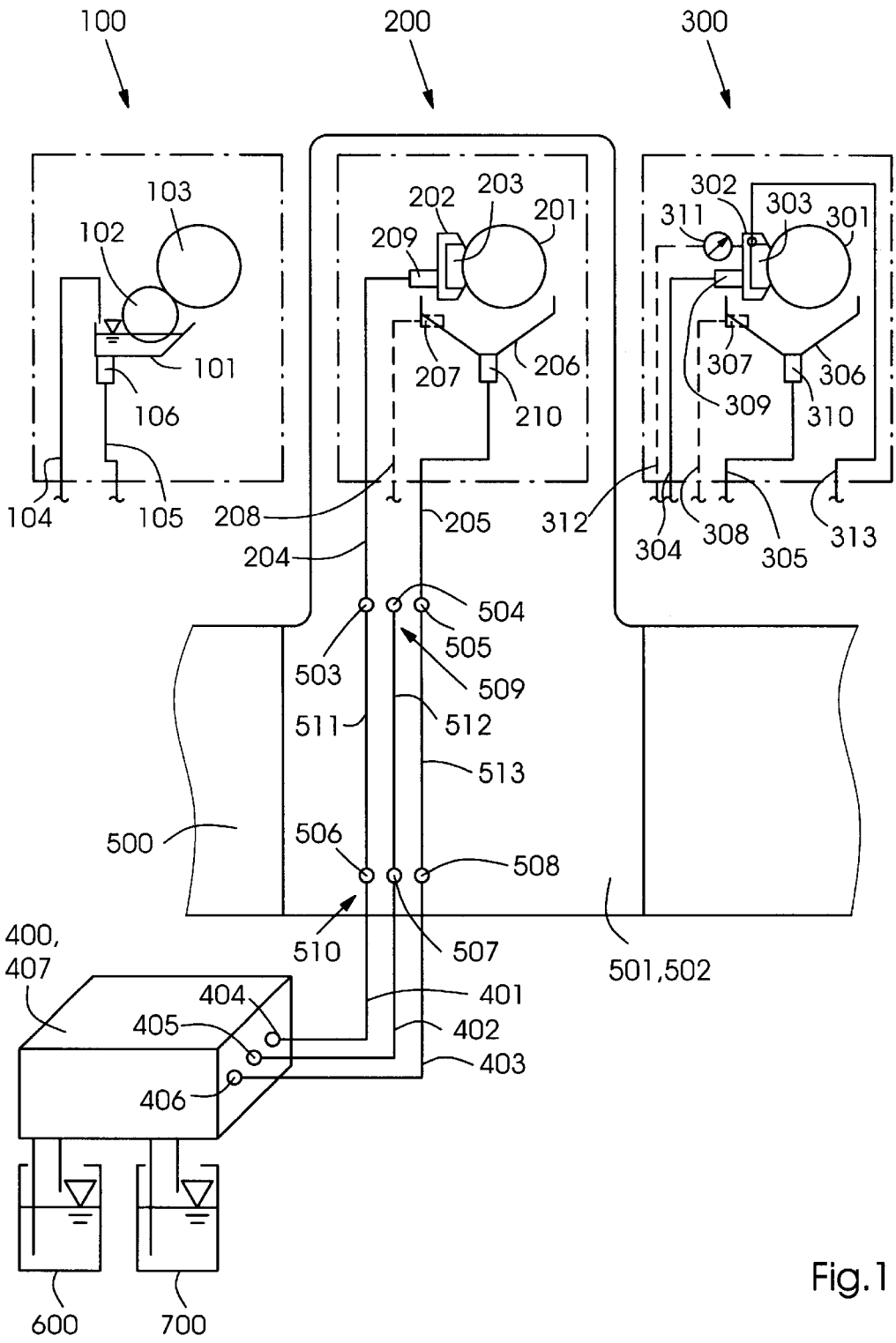
FIG. 1 is a diagrammatic and schematic view of a coating system with three different metering devices and a supply unit.

Referring now to the figures of the drawings in detail and first, particularly, to FIG. 1 thereof, there is seen a coating system including a first metering device 100, a second metering device 200, a third metering device 300 and a supply unit 400.

The first metering device 100 further includes a storage trough 101 for an intermediate storage of a first coating liquid, a dip roller 102 for scooping the first coating liquid out of the storage trough 101, and a transfer roller 103 bearing against the dip roller 102 and having a smooth, i.e., non-engraved or non-screened circumferential surface. A hoselike supply line 104 projects into the storage trough 101 and a hoselike discharge line 105 is connected, via a connection 106 in the form of a tubular nipple, to an outflow or outlet of the storage trough 101. The function and construction of the first metering device 100 correspond with the scoop-roller metering principle.

The second metering device 200 includes an engraved or screen roller 201 and a doctor blade 202 which bears against the engraved roller 201 and which is constructed as a chambered doctor blade with a liquid chamber 203. A second coating liquid is disposed, purely under static or passive pressure thereof, in the liquid chamber 203. A hoselike supply line 204 is connected to the doctor blade 202, which is equipped with a connection 209 in the form of a tubular nipple, the supply line 204 being slipped tightly onto the connection 209. A hoselike discharge line 205 is connected, via a connection 210 of a collecting trough 206, which is formed as a tubular nipple, to an outflow or outlet of this collecting trough 206 which is disposed below the engraved or screen roller 201 and the doctor blade 202 and which collects drops of the second coating liquid splashing off therefrom or run-off leakage streams of the second coating liquid. To the collecting trough 206 there is assigned a filling-level sensor 207 which detects a liquid level of a fraction of the second coating liquid located in the collecting trough 206, and signals the overshooting of a limit value by the liquid level by a signal which triggers an alarm and/or a countermeasure preventing the second coating liquid from flowing over an upper edge of the collecting trough 206. An electrical signal line 208 conducting the signal is connected to the filling-level sensor 207.

The third metering device 300 is structurally identical with the second metering device 200, except for the differences explained in greater detail hereinbelow. The structural elements identified by the reference numerals 201 to 210 with regard to the second metering device 200 are present identically in the third metering device 300 and are identified by the reference numerals 301 to 310, respectively. Instead of the second coating liquid, a third coating liquid is metered by the third metering device 300. Another difference from the second metering device 200 is that the fraction of the third coating liquid which is located in the liquid chamber 303 of the doctor blade 302 of the third metering device 300 is not only under static pressure, but also under excess and dynamic pressure. The excess and dynamic pressure is measured and regulated by an analog pressure sensor 311 which is assigned to the doctor blade 302 and to which an electrical signal line 312 is connected. A final difference is that not only the supply line 304, but also a hoselike discharge line 313, are connected to the doctor blade 302.

Both the second metering device 200 and the third metering device 300 correspond in function and construction with the anilox metering principle.

A coating machine 500, especially a sheet-fed offset rotary printing machine, includes, in addition to non-illustrated offset printing units, also a coating unit 501 equipped with a likewise non-illustrated coating cylinder which applies the first, second or third coating liquid to a sheetlike print carrier or printing material, depending upon whether the first metering device 100, the second metering device 200 or the third metering device 300 is inserted into the coating unit 501 for the printing order to be processed. The metering devices 100, 200 and 300 are dimensioned so as to be exchangeable in relation to one another, and the coating unit 501 is equipped with various mountings and holders for the metering devices 100, 200 and 300. A flexographic form for spot coatings or a rubber blanket for full-surface coating may selectively be clamped onto the coating cylinder. The coating liquids may be a zinc white primer, a metallic printing ink or a clear varnish. Depending upon the nature of the coating liquid to be used for the respective printing order, one of the metering devices 100, 200 and 300 standing ready is selected for insertion in the coating unit 501 and is installed in the latter.

Couplings 503 to 508 are combined in groups 509 and 510, in a similar manner into multiple plug sockets, which are disposed on a machine stand 502 of the coating machine 500, especially on a side wall of the coating unit 501. The fixed configuration of the couplings 503 to 508 is advantageous with regard to operating safety and handling. Each of the groups 509, 510 is made up of at least three of the couplings 503 to 508. The couplings 503 to 505 of the group 509 lying nearer the metering device 100, 200 or 300 inserted into the coating unit 501 are connected via hoselike connecting lines 511, 513 to the couplings 506 to 508 of the group 510 lying nearer the supply unit 400.

A coupling end of the coupling 503 which is opposite the connecting line 511 is constructed so as to be closable together with the supply line 104, 204 or 304, depending upon which of the metering devices 100 to 300 is to be used. Should the supply lines 104, 204 and 304 have inside diameters different from one another, compatibility could be ensured by three shoulders of the coupling 503 which are disposed in a stepwise manner or by three adapters assigned to the supply lines 104, 204 and 304. Each of the aforementioned shoulders would have a different outside diameter which, together with an inside diameter of one of the supply lines 104, 204 and 304, would result in a press fit, so that each of the supply lines 104, 204 and 304 would be capable, with the elastic widening of the inside diameter thereof, of being slipped tautly and with an exact fit on the shoulder provided in each case for the corresponding supply line 104, 204 or 304. Each of the adapters, which are insertable between the coupling 503 and the supply lines 104, 204 and 304, would be matched dimensionally in diameter with another of the supply lines 104, 204 and 304. In a preferred embodiment, neither the shoulders disposed in a stepped or stepwise manner nor the adapters are necessary, and the supply lines 104, 204 and 304 have inside diameters identical with one another.

A coupling end of the coupling 504, which is located opposite to the connecting line 512, is constructed so as to be selectively closable together with the discharge line 105, the discharge line 205 and the discharge line 305. Compatibility between the coupling 504 and the discharge lines 105, 205 may be attained by shoulders of the coupling 504 which are disposed in a stepwise manner, adapters assigned to the discharge lines 105, 205 or preferably a mutually identical dimensioning of the inside diameters of the discharge lines 105, 205.

A coupling end of the coupling 505 which is opposite a coupling end at which the connecting line 513 is closed together with the coupling 505 is constructed so as to be closable together with the discharge line 313.

Hoselike connecting lines 401 to 403 connected to the supply unit 400 are constructed so as to be closable together with coupling ends of the couplings 506 to 508 which are located at the other end of the couplings 506 to 508 than the connecting lines 511 to 513.

The couplings 503 to 508 are quick-action hose couplings in the form of a tubular nipple and are constructed so as to be pluggable together and/or screwable together with the connecting lines 104, 105, 204, 205, 304, 305, 313, 401, 402, 403, 511, 512 and 513.

According to a modification not illustrated in greater detail, the connecting lines 511 to 513 may be tubes instead of hoses, and the connecting lines 104, 105, 204, 205, 304, 305, 313, 401, 402 and 403 may be plugged together and/or screwed together with tube ends of the tubes. These tubes, via which the connecting lines 401 to 403 would be couplable together with the connecting lines 104, 105 or 204, 205 or 304 to 305, would form a single coupling group consisting of three couplings, namely the tubes, and that single coupling group would replace the groups 509, 510.

Figure 2:
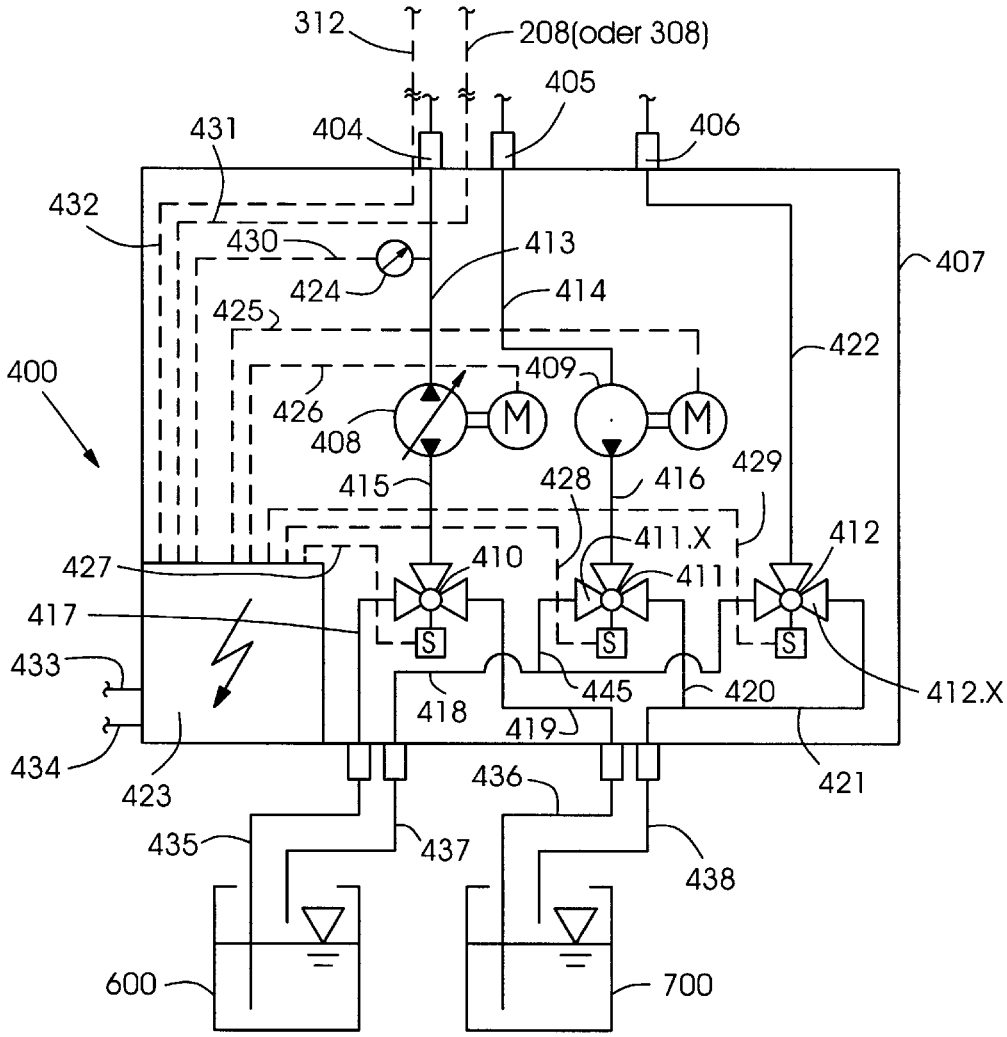
FIG. 2 is a fragmentary, diagrammatic and schematic view of FIG. 1 showing a different embodiment of the supply unit.

The supply unit 400, in the embodiment constructed in accordance with FIG. 2, is equipped with connections 404 to 406 for the connecting lines 401 to 403 and has, as a stand for fastening the parts mentioned hereinbelow, a closed housing 407, within which there are disposed pumps 408, 409 together with-motors M associated therewith, selection valves 410 to 412 and actuating drives S associated with the latter, hollow lines 413 to 422, an electrical control device 423, an analog pressure sensor 424, control lines 425 to 429 for connecting the motors M and actuating drives S to the control device 423, and a signal line 430 for connecting the pressure sensor 424 to the control device 423.

In contrast with the second pump 409 which has only a single conveying direction, the first pump 408 is a reversing pump, the conveying direction of which is reversible. The selection valves 410 to 412 are multiway ball valves. Tubes and hoses may be used as the hollow lines 413 to 422. The pressure sensor 424 may be present for reference measurement alternatively to the pressure sensor 311 or additionally to the latter. The control lines 425 to 429 may be electrical lines, if the motors M and actuating drives S are of the electrical type. If, however, the actuating drives S are of the pneumatic type, the control lines 427 to 429 may be pneumatic lines, and the control device 423 may contain an electropneumatic coupler. The control device 423 is equipped with signal lines 431, 432 which are selectively closable together with the signal lines 208, 308 and 312. Moreover, the control device 432 has a control line 433, via which the control device 432 is linked in control-technology terms to a central control of the coating machine 500, so that, for example, there is afforded a regulation of the rotational speed of the motor M of the first pump 408 and consequently of the conveying capacity of the first pump 408, the regulation being dependent upon the printing speed of the coating machine 500. Furthermore, for a power supply, the control device 433 is connected to an electrical voltage source via an electrical line 434.

Outside the supply unit 400 and the housing 407, there are disposed a coating-liquid reservoir 600 and a cleaning-liquid reservoir 700. The coating-liquid reservoir 600 contains the first, second or third coating liquid, i.e., there are an interchangeable reservoir with the first coating liquid, an interchangeable reservoir with the second coating liquid, and an interchangeable reservoir with the third coating liquid, and that one of the three interchangeable reservoirs which becomes necessary, respectively, for the pending printing order is connected as the coating-liquid reservoir 600 to the supply unit 400. Suction lines 435, 536 terminating below the liquid level, and return lines 437, 438 terminating above the liquid level project into the reservoirs 600, 700 connected to the supply unit 400.

The supply unit 400, on the one hand, is connectable by appropriate settings of the supply unit 400, together with the coating-liquid reservoir 600 and the respectively used metering device 100, 200 or 300, so as to form a coating-liquid circuit and, on the other hand, are connectable together with the cleaning-liquid reservoir 700 and the respectively selected metering device 100, 200 or 300, so as to form a cleaning-liquid circuit.

Figure 3:
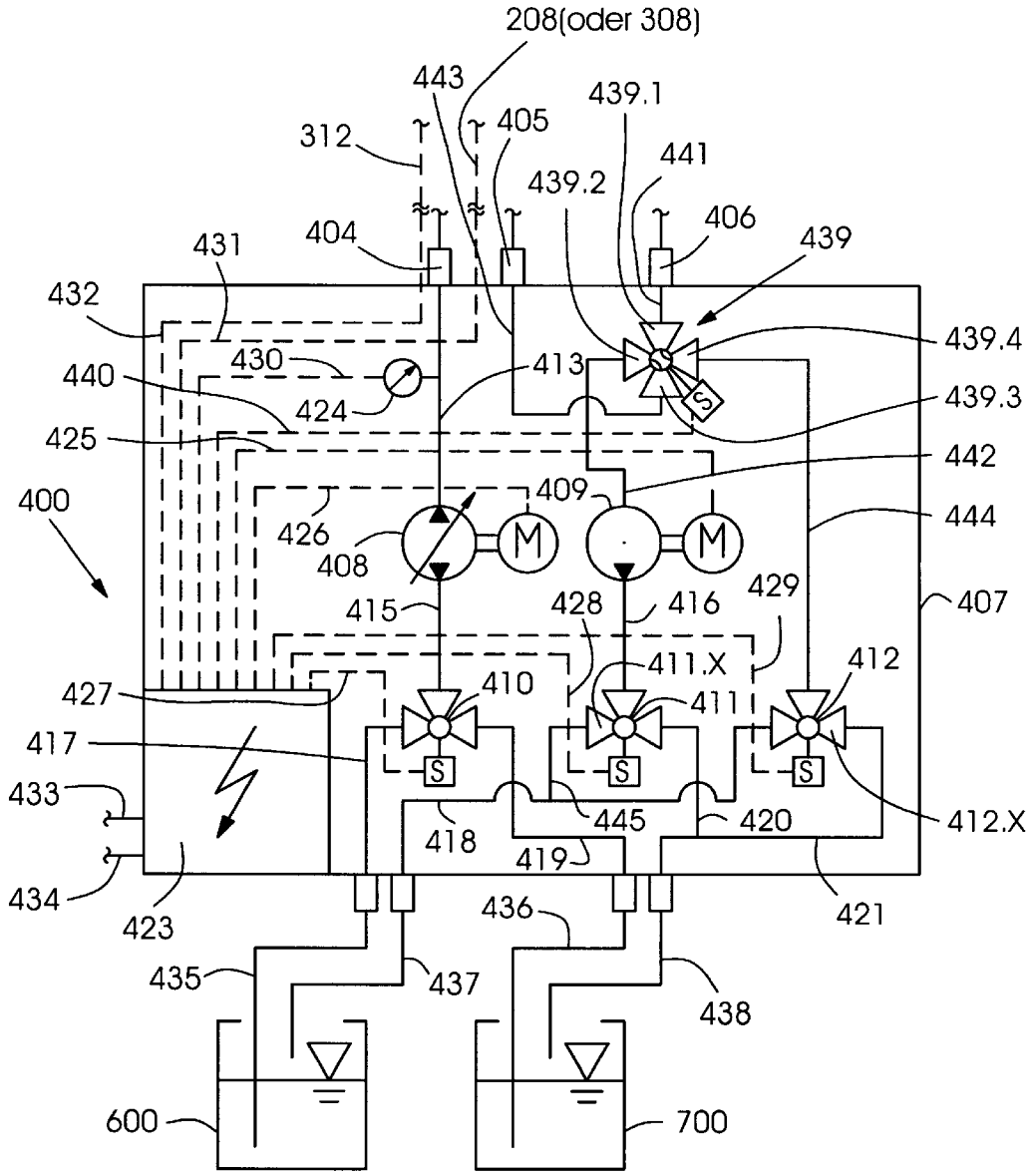
FIG. 3 is a view similar to FIG. 2 showing another different embodiment of the supply unit.

FIG. 3 illustrates a construction of the supply unit 400 alternative to that of FIG. 2.

It may be emphasized, at this point, that only a single supply unit 400, which may be either the supply unit 400 illustrated in FIG. 2 or the supply unit 400 illustrated in FIG. 3, is necessary in order to operate the metering devices 100, 200 and 300, and this single supply unit 400 of the coating system is constructed so as to be compatible with all of the metering devices 100, 200 and 300.

It is believed to be evident, from the reference numerals adopted in FIG. 3 to identify parts therein which are identical with those identified by corresponding reference numerals in FIG. 2, that the embodiment of the supply unit 400 illustrated in FIG. 3 differs from the embodiment of the supply unit 400 illustrated in FIG. 2 only by the differences explained in greater detail hereinbelow and is otherwise constructed identically with that embodiment which is illustrated in FIG. 2, so that the description already provided herein with regard to the identical parts in connection with FIG. 2 applies equally to FIG. 3. The essential difference between the two different embodiments is provided by the presence of a further selection valve 439 which is likewise integrated into the housing 407 of the embodiment illustrated in FIG. 3 and which is constructed as a multiway ball valve. The selection valve 439 has at least four valve connections 439.1 to 439.4 occupied by hoselike or tubular hollow lines 441 to 444, and can be changed over into at least two, preferably three, different switching positions by an actuating drive S, which is activatable by the control device 423 via a control line 440, so that a first flowthrough path from the valve connection 439.1 to the valve connection 439.4, a second flowthrough path from the valve connection 439.3 to the valve connection 439.2 and, if appropriate, a third flowthrough path from the valve connection 439.1 to the valve connection 439.2 are selectively settable.

Various functions of the coating system and control methods for the two different embodiments of the supply unit 400 are described hereinbelow.

The coating system can be operated in various operating modes.

A first operating mode presupposes that the pressman has already inserted the metering device 100 into the mountings and holders of the coating unit 501 which are provided for this purpose and has also already closed the lines 104, 105 together with the couplings 503, 504. In the first operating mode, the selection valve 410 is switched in such a way that the first coating liquid can flow through the latter out of the hollow line 417 over into the hollow line 415. The conveying direction of the first pump 408 is set in such a way that the latter conveys the first coating liquid out of the hollow line 415 and into the hollow line 413. The first coating liquid sucked up from the coating-liquid reservoir 600 thus flows via the suction line 435, the hollow line 417, the selection valve 410, the hollow line 415, the first pump 408, the hollow line 413, the connection 404, the connecting line 401, the coupling 506, the connecting line 511, the coupling 503 and the connecting line 104 in that sequence into the storage trough 101. A particular fraction of the liquid located in the storage trough 101 is metered by the rollers 102, 103 and is transferred onto the coating cylinder. That fraction of the first coating liquid which is not printed on by the coating cylinder is sucked up by the second pump 409 via the connection 106, the discharge line 105, the coupling 504, the connecting line 512, the coupling 507, the connecting line 402 and the connection 403 and pumped back via the hollow line 416, the selection valve 411, the hollow line 445, the hollow line 418 and the return line 437 into the coating-liquid reservoir 600, so that a continuous circulation of the first coating liquid in the coating system is attained. In this regard, the selection valve 411 has a switching position wherein only the flowthrough path from the hollow line 416 into the hollow line 445 is free. The path which the first coating liquid follows from the connection 405 to the second pump 409 is quite different in the different embodiments of the supply unit 400 which are illustrated in FIGS. 2 and 3. In the embodiment illustrated in FIG. 1, the first coating liquid flows directly from the connection 405 through the hollow line 414 into the second pump 409. In the different embodiment illustrated in FIG. 3, the selection valve 439 is in a switching position wherein the flowthrough path from the valve connection 439.3 to the valve connection 439.2 is free and all the other flowthrough paths of the selection valve 439 are blocked, and the first coating liquid flows out of the connection 405 via the hollow line 443, the selection valve 439 and the hollow line 442 into the second pump 409.

A second operating mode serves for making ready or preparing for a change of the coating liquid, such a change being necessary so that, in a following printing order, a coating liquid different from the first coating liquid can be printed on by the first metering device 100 or one of the other metering devices 200, 300. The second operating mode requires that the conveying direction of the first pump 408 be changed over by the control device 423, for example by a change in the direction of rotation of the motor M driving the first pump 408, so that the first pump 408 conveys the first coating liquid out of the hollow line 413 into the hollow line 415. The path which the first coating liquid follows from the supply line 104 through the supply unit 400 and the suction line 435 thereof functioning in the second operating mode as a return line, towards the coating-liquid reservoir is opposite to the path in the first operating mode. Exactly as in the first operating mode, the two pumps 408, 409 also operate simultaneously in the second operating mode. The path along which the first coating liquid is pumped out of the storage trough 101 through the supply unit 400 back into the coating-liquid reservoir 600 by the second pump 409 during the second operating mode is the same path which the first coating liquid also follows in the first operating mode. In contrast with the first operating mode, wherein the volume of the first coating liquid stored in the storage trough 101 is kept at least approximately constant, in the second operating mode, the storage trough 101 is emptied at least approximately completely.

After the second operating mode, the coating system is operated in a third operating mode, in order to remove impurities (residual quantities of the first coating liquid) which have remained in the coating system from the first metering device 100 and the supply unit 400. For this purpose, the selection valves 410, 411, 412 and, when a different embodiment of the supply unit 400 as illustrated in FIG. 2 is used, also the selection valve 439 are put by the control device 423 into switching positions which allow the cleaning liquid to circulate through the entire coating system. In more precise terms, the flow path of the cleaning liquid from the hollow line 415 as far as the hollow line 416 exactly corresponds in the third operating mode to the flow path of the first coating liquid in the first operating mode. In contrast with the first operating mode, the selection valve 410, in the second operating mode, is set to permit passage from the hollow line 419 to the hollow line 415, and the selection valve 411 is set to permit passage from the hollow line 416 to the hollow line 420, so that the cleaning liquid is sucked by the first pump 408 via the suction line 436 out of the cleaning-liquid reservoir 700 and is returned to the latter by the second pump 409 via the return line 438.

Before the coating liquid to be used for the following printing order is employed after scavenging the coating system by the cleaning liquid, it is necessary to remove the cleaning liquid at least approximately completely from the first metering device 100 and the supply unit 400. For this purpose, the coating system is operated in a fourth operating mode, which differs from the third operating mode only in the changed conveying direction of the first pump 408. In the third operating mode, the control device 423 controls the motorized first pump 408 in such a way that the latter conveys the cleaning liquid out of the hollow line 415 into the hollow line 413. In contrast therewith, in the fourth operating mode, the first pump 408 or the motor M thereof is activated by the control device 423 in such a way that the first pump 408 pumps the cleaning liquid out of the hollow line 413 and into the hollow line 415.

After the conclusion of the fourth operating mode, the first metering device 100 is replaced by the second metering device 200, the lines 104, 105 being pulled off from the couplings 503, 504, and the lines 204, 205 being closed together with the latter. Moreover, the coating-liquid reservoir 600 is replaced by one containing the second coating liquid. The suction line 435 dipping into the coating liquids and therefore "dirtied" by the first coating liquid can be replaced by a replacement suction line, because connections structurally identical with the connections 404 to 406 are provided on the supply unit 400 for the lines 435 to 438. The coating of the print carrier, using the second metering device 200, corresponds to a fifth operating mode of the coating system. In this regard, the second coating liquid flows along exactly the same flow path through the supply unit 400 and back again as the first coating liquid in the first operating mode. The fifth operating mode differs from the first operating mode only in that the second coating liquid is pumped from the coupling 503 via the supply line 204 into the doctor blade 202 and is pumped out of the collecting trough 210 via the discharge line 205 towards the coupling 504. During the fifth operating mode, the pumps 408, 409 operate in parallel in exactly the same way as in the first operating mode. Contrary thereto, however, there may also be provision for the control device 423 to activate the second pump 409 only when the control device 423 receives from the filling-level sensor 207 a signal that the second coating liquid accumulating in the collecting trough 206 has reached a maximum permissible filling level and threatens to overflow.

According to this modification, therefore, in the fifth operating mode, the second pump 409 would not operate continuously, but only as required.

A sixth operating mode (removal of the second coating liquid from the second metering device 200 and the supply unit 400), a seventh operating mode (scavenging of the supply unit 400 and the second metering device 200 by the cleaning liquid) and an eighth operating mode (removal of the cleaning liquid from the supply unit 400 and the second metering device 200) correspond with the second, third and fourth operating modes, besides the difference that, in this regard, the liquids do not flow through the first metering device 100, but through the second metering device 200, and therefore do not need to be described again in all of the details thereof.

In a ninth, tenth, eleventh and twelfth operating mode, the third metering device 300 is used. In the installation of the latter in the coating unit 501, it must be remembered that not only is the supply line 304 to be connected to the coupling 503, and the discharge line 305 to the coupling 504, but the additional discharge line 313 is also to be connected to the coupling 505.

In the ninth operating mode, the third coating liquid is circulated through the coating system during the coating of the print carrier, this circulation being driven solely by the first pump 408, not by the second pump 409. In the different embodiment of the supply unit 400 illustrated in FIG. 2, the flow path of the third coating liquid out of the coating-liquid reservoir 600 through the supply unit 400 and the third metering device 300 as far as the connection 406 is exactly the same as in the embodiment illustrated in FIG. 3. In both different embodiments, the coating liquid, during the circulation thereof, flows in the hereinafter-mentioned sequence through the suction line 435, the hollow line 417, the selection valve 410, the hollow line 415, the first pump 408, the hollow line 413, the connection 404, the connecting line 401, the coupling 506, the connecting line 511, the coupling 503, the supply line 304, the connection 309, the doctor blade 302 and the discharge line 313. When the different embodiment of the supply unit 400 illustrated in FIG. 2 is used to implement the ninth operating mode, the selection valve 412 must be set in such a way that a flowthrough path is opened in the latter from the hollow line 422 to the hollow line 418, so that the third coating liquid can be pumped from the connection 406 via the hollow line 422, the selection valve 412, the hollow line 418 and the return line 437 in that sequence back into the coating-liquid reservoir 600 again. When the desired embodiment of the supply unit 400, as illustrated in FIG. 3, is used, the selection valve 439 is set by the control device 423 in such a way that a first flowthrough path from the valve connection 439.1 to the valve connection 439.4 and, at the same time, a second flowthrough path from the valve connection 439.3 to the valve connection 439.2 are free. All the other flowthrough paths of the selection valve 439 are blocked during this time. Moreover, the selection valve 412 is set in such a way that the third coating liquid can flow out of the hollow line 444 via the selection valve 412 over into the hollow line 418. Thus, in the ninth operating mode, the third coating liquid follows the path thereof in the hereinafter-mentioned sequence from the connection 406 via the hollow line 441, the selection valve 439, the hollow line 444, the selection valve 412, the hollow line 418 and the return line 437 into the coating-liquid reservoir 600. In the ninth operating mode and also in the eleventh operating mode which is also described hereinbelow, the control device 423 co-operates with the second pump 409 and the filling-level sensor 309 in exactly the same way as has already been described above with regard to the fifth and seventh operating modes, i.e., the second pump 409 operates only sporadically and is switched on by the control device 423, in response to the signal from the filling-level sensor 309, only when the filling-level height in the collecting trough 306 has reached a predetermined limit value and the collecting trough 306 threatens to overflow. During the pumping away of the third coating liquid out of the collecting trough 306 which takes place in the emergency situation described, in the different embodiment of the supply unit 400 illustrated in FIG. 2, the third coating liquid flows from the connection 405 via the hollow line 414, the second pump 409, the hollow line 416, the selection valve 411, the hollow line 445, the hollow line 418 and the return line 437 back into the coating-liquid reservoir 600. In the different embodiment of the supply unit 400 illustrated in FIG. 3, the path of the third coating liquid, sucked away from the collecting trough 306, from the second pump 409 as far as the coating-liquid reservoir 600 is exactly the same as in the embodiment illustrated in FIG. 2 and, in contrast with the latter, the sucked-away third coating liquid flows from the connection 405 via the hollow line 443, the selection valve 439 and the hollow line 442 to the second pump 409.

If, after the execution of the printing order to be printed or varnished with the third coating liquid, the third coating liquid has to be replaced by a new coating liquid to be used for a following printing order, it is necessary, after the introduction of the new coating liquid into the coating system, to carry out the method steps corresponding to the tenth, eleventh and twelfth operating modes.

The tenth operating mode serves for removing the third coating liquid from the third metering device 300 and from the supply unit 400. In this regard, the first pump 408 is operated with a conveying direction which is changed with respect to the ninth operating mode, so that the third coating liquid is pumped out of the liquid chamber 303 of the doctor blade 302 via the supply line 304, the coupling 503, the connecting line 511, the coupling 506, the connecting line 401, the connection 404, the hollow line 413, the first pump 408, the hollow line 415, the selection valve 410, the hollow line 417 and finally the suction line 435, functioning in this case as a return line, in that sequence back into the coating-liquid reservoir 600. In the different embodiment of the supply unit 400 illustrated in FIG. 2, due to the vacuum generated in the liquid chamber of the doctor blade 302 by the first pump 408, the third coating liquid flows in the hereinafter-mentioned sequence out of the return line 437, via the hollow line 418, the selection valve 412, the hollow line 422, the connection 406, the connecting line 403, the coupling 508, the connecting line 513, the coupling 505 and the discharge line 313, first back into the liquid chamber 303 of the doctor blade 302 and then, via the hereinafore-described suck-away flow path from the connection 309 via the suction line 435 likewise back into the coating-liquid reservoir 600. So that, during this sucking away, no distributing infiltrated air from the collecting trough 306 open to the surroundings or from the return line 438, likewise open to the surroundings, is sucked in via the selection valves 411, 412, the selection valve 411 is set to a single flowthrough path, to be precise the path connecting the hollow line 416 to the hollow line 420, and the selection valve 412 is likewise set to a single flowthrough path, to be precise that path connecting the hollow line 422 to the hollow line 418. Valve connections, identified by the reference characters 411.x and 412.x, of the respective selection valves 411, 412 are thus blocked.

Deviating from the empty sucking of the flow path commencing with the return line 437 and ending with the discharge line 313, however, as described in connection with the tenth operating mode, provision may also be made for causing the third coating liquid simply to flow out of the flow path into the coating-liquid reservoir 600 without assistance by the first pump 408, the third coating liquid flowing from the discharge line 313 to the return line 437. So that no vacuum which obstructs the outflow occurs in the flow path, an aeration or ventilation of the doctor blade 302 is necessary in this modification of the tenth operating mode.

The path which, in the different embodiment of the supply unit 400 illustrated in FIG. 3, the third coating liquid follows, during emptying, from the connection 309 via the suction line 435 into the coating-liquid reservoir 600 is exactly the same as in the embodiment illustrated in FIG. 2. In the different embodiment illustrated in FIG. 3, however, there are two different possibilities regarding the emptying of the line system following the doctor blade 302 and ending in the lines 313 and 437. In the first possibility, the third coating liquid is conveyed out of the last-mentioned line system by the first pump 408 initially back into the doctor blade 302 and thereafter out of the latter into the coating-liquid reservoir 600 in exactly the same way as in the embodiment according to FIG. 2. That, in this regard, the third coating liquid is pumped from the selection valve 412 via the hollow line 444, the selection valve 439 and the hollow line 441 to the connection 406 is believed to be quite obvious.

As the second possibility for emptying the line system following the doctor blade 302, a provision is made for using the second pump 409 for this purpose. The two pumps 408 and 409 operate, in this regard, in parallel, specifically in a manner that, as already described hereinbefore, the line system preceding the doctor blade 302 is emptied by the first pump 408 and, at the same time, the line system following the doctor blade 302 is emptied by the second pump 409. For this purpose, the control device 423 switches the selection valves 439 and 411 into switching positions so that the fraction of the third coating liquid which is emptied out of the line system following the doctor blade 302 is pumped in the hereinafter-mentioned sequence from the connection 406 via the hollow line 441, the selection valve 439, the hollow line 442, the second pump 409, the hollow line 416, the selection valve 411, the hollow line 445, the hollow line 418 and the return line 437 into the coating-liquid reservoir 600.

After emptying the third coating liquid, residual quantities of the latter may have remained in the third metering device 300 and in the supply unit 400. The eleventh operating mode serves for scavenging the coating system by a circulation of the cleaning liquid through the latter and at the same time serves for eliminating the residual quantities.

Independently of whether the supply unit 400 is constructed in accordance with FIG. 2 or FIG. 3, the valve and pump settings set by the control device 423 differ from those of the ninth operating mode (coating) only in that, in the eleventh operating mode (cleaning), the selection valve 410 is switched to flowthrough from the hollow line 419 into the hollow line 415, and the selection valve 412 is switched to flowthrough from the hollow line 422 or 444 into the hollow line 421. The path which the cleaning liquid follows during the circulation thereof from the selection valve 410 via the third metering device 300 to the selection valve 412 corresponds exactly to the path of the coating liquid in the ninth operating mode. Exactly as in the ninth operating mode, in the eleventh operating mode, too, an overflow of the collecting trough 306 is prevented due to the interaction of the control device 423 with the filling-level sensor 309 and the second pump 409.

Regardless of whether the supply unit 400 is constructed according to FIG. 2 or FIG. 3, the flow path of the cleaning liquid in the twelfth operating mode (cleaning-liquid sucking away or emptying), which includes the third metering device 300 and lies either (when the first pump 408 is used for emptying the doctor blade 302 and the line system preceding the latter and the second pump 409 is used for emptying the line system following the doctor blade 302) between the selection valves 410 and 411 or (when the first pump 408 is used for emptying both the line system preceding the doctor blade 302 and the line system following the doctor blade 302) between the selection valves 410 and 412, does not differ from the corresponding flow path of the third coating liquid in the tenth operating mode (coating-liquid emptying or sucking away). If the emptying possibility, using both pumps 408, 409, is employed, in the twelfth operating mode, the selection valve 410 is set to a flowthrough path connecting the hollow line 415 to the hollow line 419, and the selection valve 411 is set to a flowthrough path connecting the hollow line 416 to the hollow line 420, so that the cleaning liquid is sucked up by the first pump 408 in the hereinafter-mentioned sequence via the suction line 436, the hollow line 419, the selection valve 410 and the hollow line 415 and is pumped by the second pump 409 in the hereinafter-mentioned sequence via the hollow line 416, the selection valve 411, the hollow line 420, the hollow line 421 and the return line 438 back into the cleaning-liquid reservoir 700. If the other emptying possibility, using only the first pump 408, is employed, in the twelfth operating mode, the selection valve 410 is set to the flowthrough path connecting the hollow line 415 to the hollow line 419, and the selection valve 412 is set to a flowthrough path connecting the hollow line 422 or 444 to the hollow line 421, so that the cleaning liquid is, by the first pump 408, both sucked up from the cleaning-liquid reservoir 700 via the suction line 436, the hollow line 419, the selection valve 410 and the hollow line 415 and conveyed via the hollow line 421 and the return line 438 back into the cleaning-liquid reservoir 700.

We claim:

1. A coating system for coating print carriers, comprising:

at least one pump;

at least one selection valve;

a first metering device; and a second metering device;

said first metering device and said second metering device being constructed differently from one another with respect to metering principles thereof; and said at least one pump and said at least one selection valve being assembled into a modular supply unit constructed so as to be compatible both with said first and with said second metering device.

2. The coating system according to claim 1, wherein said first metering device includes a storage trough and a dip roller, in accordance with a scoop-roller metering principle.

3. The coating system according to claim 1, wherein said second metering device includes a doctor blade and a screen roller, in accordance with an anilox metering principle.

4. The coating system according to claim 1, further comprising connecting lines for connecting said supply unit to said first metering device.

5. The coating system according to claim 4, wherein said first metering device and said second metering device have respective connections, and one of said connecting lines is connected to said connection of said first metering device and is constructed for fitting together with said connection of said second metering device for connecting to said connection of said second metering device.

6. The coating system according to claim 4, wherein said connecting lines are coupled via couplings with further connecting lines connected to said supply unit.

7. The coating system according to claim 6, further comprising a coating machine having said first metering device, said coating machine having a machine stand, and said couplings being locally fixed on said machine stand.

8. The coating system according to claim 1, further comprising a selection valve, said supply unit having a stand, and said pump and said selection valve being fastened to said stand.

9. The coating system according to claim 8, wherein said stand is a closed housing, and said pump and said selection valve are disposed within said closed housing.

10. The coating system according to claim 9, further comprising a coating-liquid reservoir associated with said supply unit, said reservoir being disposed outside said housing.

11. A coating machine, comprising a coating system for coating print carriers, said coating system including:

at least one pump;

at least one selection valve;

a first metering device; and a second metering device;

said first metering device and said second metering device being constructed differently from one another with respect to metering principles thereof; and said at least one pump and said at least one selection valve being assembled into a modular supply unit being compatible both with said first and with said second metering device.

12. A printing machine, comprising a coating system for coating print carriers, said coating system including:

at least one pump;

at least one selection valve;

a first metering device; and a second metering device;

said first metering device and said second metering device being constructed differently from one another with respect to metering principles thereof; and said at least one pump and said at least one selection valve being assembled into a modular supply unit being compatible both with said first and with said second metering device.

13. A varnishing machine, comprising a coating system for coating print carriers, said coating system including:

at least one pump;

at least one selection valve;

a first metering device; and a second metering device;

said first metering device and said second metering device being constructed differently from one another with respect to metering principles thereof; and said at least one pump and said at least one selection valve being assembled into a modular supply unit being compatible both with said first and with said second metering device.

* * * * *